US006264423B1

(12) United States Patent
Andresen

(10) Patent No.: US 6,264,423 B1
(45) Date of Patent: Jul. 24, 2001

(54) METHOD OF INSTALLING AN OVERHEAD GARAGE DOOR OPENER

(76) Inventor: Michael J. Andresen, 11 Racker Rd., Stafford Springs, CT (US) 06076

( * ) Notice: Subject to any disclaimer, the term of this patent is extended or adjusted under 35 U.S.C. 154(b) by 0 days.

(21) Appl. No.: 09/434,383

(22) Filed: Nov. 5, 1999

(51) Int. Cl.[7] ..... E04G 21/14
(52) U.S. Cl. ..... 414/800; 414/11
(58) Field of Search ..... 414/10, 11, 800

(56) References Cited

U.S. PATENT DOCUMENTS

| | | | | |
|---|---|---|---|---|
| 2,672,319 | * | 3/1954 | Nelson | 414/10 |
| 2,719,060 | * | 9/1955 | Taylor | 414/11 |
| 3,178,038 | * | 4/1965 | Love | 414/11 |
| 3,314,553 | * | 4/1967 | Vircks | 414/11 |
| 3,382,988 | * | 5/1968 | O'Reilly | 414/11 |
| 3,828,942 | * | 8/1974 | Young | 414/11 |
| 4,560,031 | * | 12/1985 | Dixon et al. | 414/11 X |
| 4,600,348 | * | 7/1986 | Pettit | 414/11 |
| 5,368,429 | * | 11/1994 | Young | 414/11 |
| 5,658,124 | * | 8/1997 | Presnell | 414/11 X |
| 5,700,123 | * | 12/1997 | Rokosh et al. | 414/11 |
| 5,704,755 | * | 1/1998 | Jesperson | 414/11 |
| 5,984,605 | * | 11/1999 | Young | 414/11 |

* cited by examiner

*Primary Examiner*—Robert P. Olszewski
*Assistant Examiner*—Gerald J. O'Connor

(57) ABSTRACT

A hoist for a garage door opener has three main components. A base which is sufficiently wide to provide stability and has wheels to facilitate placement of the device, an extensible shaft extending from said base, and a self leveling workpiece holder for holding said garage door opener in position for installation. Installation of the garage door opener is then accomplished by placing the motor and motor housing of the opener on the workpiece holder and positioning the free end of the drive shaft of the opener above the door. Then the extensible shaft of the device is raised until the opener housing is properly positioned for installation on the garage ceiling. Once the opener housing is securely attached to the ceiling the device may be collapsed and transported or stored as required.

1 Claim, 2 Drawing Sheets

10

METHOD OF INSTALLING AN OVERHEAD GARAGE DOOR OPENER

BACKGROUND OF THE INVENTION

The present invention relates generally to a hoisting apparatus. More particularly, it relates to a hoisting apparatus which may be used to facilitate installation of a garage door opener.

STATEMENT OF THE PRIOR ART

Numerous devices have been developed for hoisting or lifting heavy or bulky objects in order to effect installation, repair or removal of the object. To that end, many different types of simple machines have been modified in order to perform highly specific tasks in a most efficient manner. Engine hoists, for instance, are configured for removing/installing a heavy object from a confined space, and there are cranes and winches which are specifically adapted for use, e.g., for loading and unloading ships.

There are also specialized devices for installing garage door openers. However, these devices, such as clamps, brackets, etc., do not facilitate the proper positioning of the garage door opener to allow the installer to place the garage door opener in position to secure it for proper operation. While there are devices used to allow workmen to access workpieces that are in elevated, difficult to reach areas, none of these has particular application for positioning a garage door opener.

U.S. Pat. No. 5,329,744 issued to Sumter discloses a device which may be used to facilitate the installation of ⅜", ½", and ⅝" gypsum board to ceilings as a temporary support devise during installation only and until permanent attachment to ceiling members can be made. The workpiece holder cannot be adapted to hold and manipulate relatively heavy machinery such as a garage door opener.

U.S. Pat. No. 5,368,429 issued to Young is another patent directed to a device for a panel lifting apparatus having at least three telescoping elongated sections telescoping into one another and all telescoping into a non-telescoping elongated frame member. The assembly is relatively complex and includes a gear driven mechanism which is not compact or easily transported from one site to the other. By contrast, the present invention utilizes a pulley driven lifting mechanism, which lifts a workpiece holder sized for holding a garage door opener. The holder, and therefore the garage door opener, may be selectively tilted as required to facilitate installation.

U.S. Pat. No. 5,329,744 issued to Herde discloses an apparatus for moving construction material relative to a building frame which includes a weighted, pivotable base, an extensible shaft projecting from the base, and a carrier assembly adjustable transversely of and pivotable relative to the shaft and including releasable grippers for holding construction material on the assembly, positioned on the shaft. A spring loaded mechanism is used to urge the workpiece into position. The workpiece holder is not "device specific" and is not specifically adapted to use with any one type of workpiece. By contrast, the present invention is directed to a workpiece manipulating device which has no springs or other elements which are subject to wear with repeated use. Also, the workpiece holder is sized and shaped for use with garage door openers and thus does not need to be interchangeable.

None of the above inventions and patents, taken either singly or in combination, is seen to describe the instant invention as claimed.

SUMMARY OF THE INVENTION

The present invention overcomes the disadvantages of the prior art by providing a hoist for a garage door opener. The device has three main components. A base which is sufficiently wide to provide stability and has wheels to facilitate placement of the device, an extensible shaft extending from said base, and a self leveling workpiece holder for holding said garage door opener in position for installation. Installation of the garage door opener is then accomplished by placing the motor and motor housing of the opener on the workpiece holder and positioning the free end of the drive shaft of the opener above the door. The extensible shaft of the device is raised until the opener housing is properly positioned for installation on the garage ceiling. Once the opener housing is securely attached to the ceiling the device may be collapsed and transported or stored as required.

Accordingly, it is a principal object of the invention to provide a new and improved hoisting apparatus specifically adapted to facilitate installation of a garage door opening.

Accordingly, it is an object of the invention to provide a new and improved hoisting apparatus which is portable and lightweight.

It is another object of the invention to provide a new and improved hoisting apparatus having an adjustable extending shaft for lifting a garage door opener motor and housing into position for attachment to a garage ceiling.

It is another object of the invention to provide a new and improved hoisting apparatus which has a pulley driven crank mechanism for raising and lowering a workpiece holder.

It is another object of the invention to provide a new and improved hoisting apparatus having a self adjusting workpiece holder adapted for supporting and positioning the motor housing of a garage door opener during the entire installation processing.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
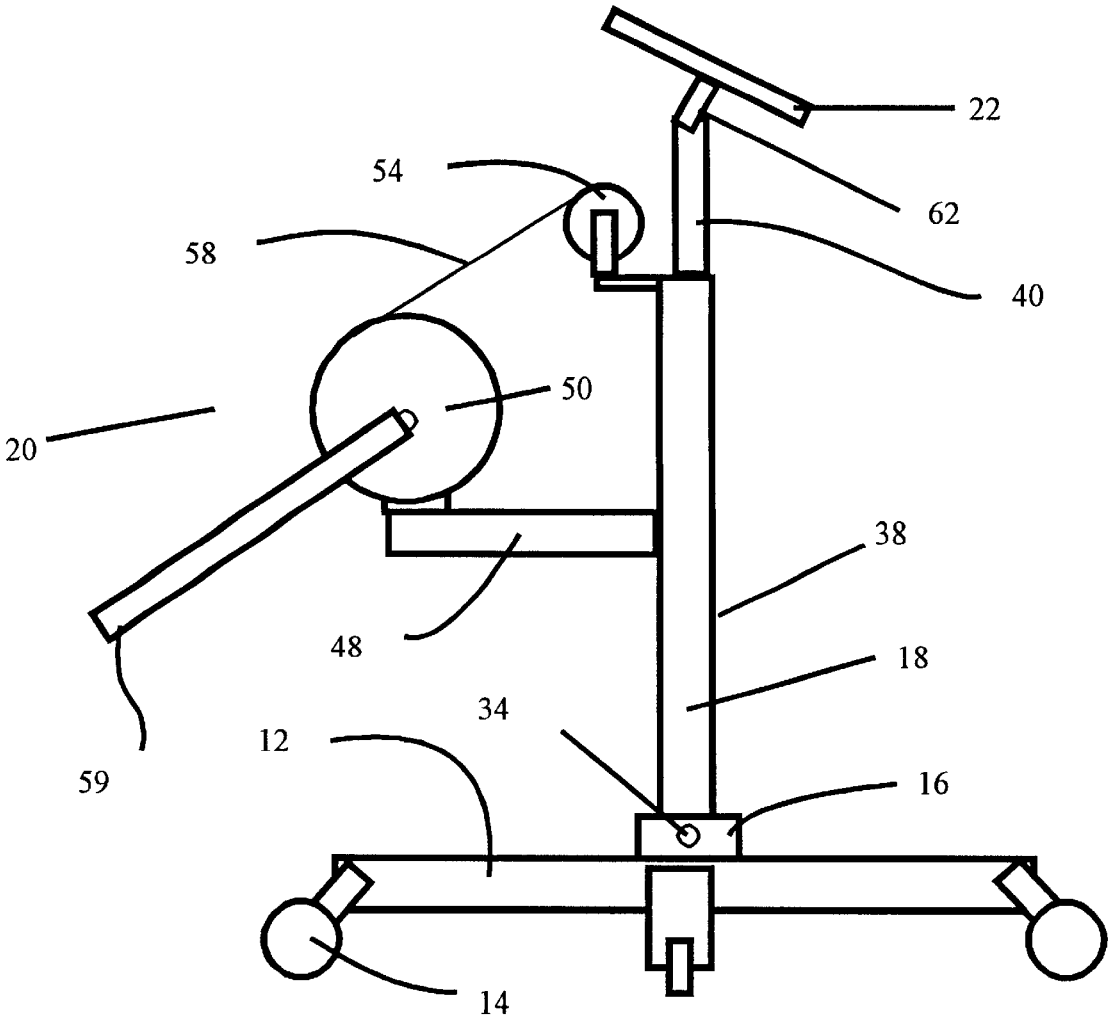
FIG. 1 shows a side view of the hoisting apparatus of the present invention.
Figure 2:
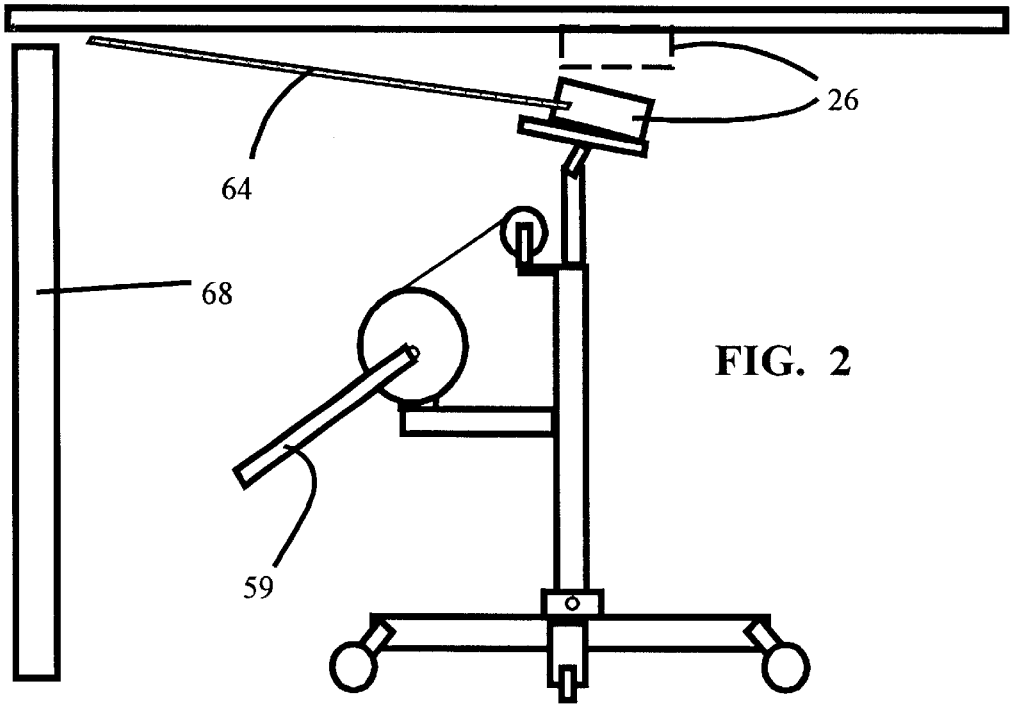
FIG. 2 shows a side view of the hoisting apparatus of the present invention with the garage door opener mounted thereon in a pre-installation position.
Figure 3:
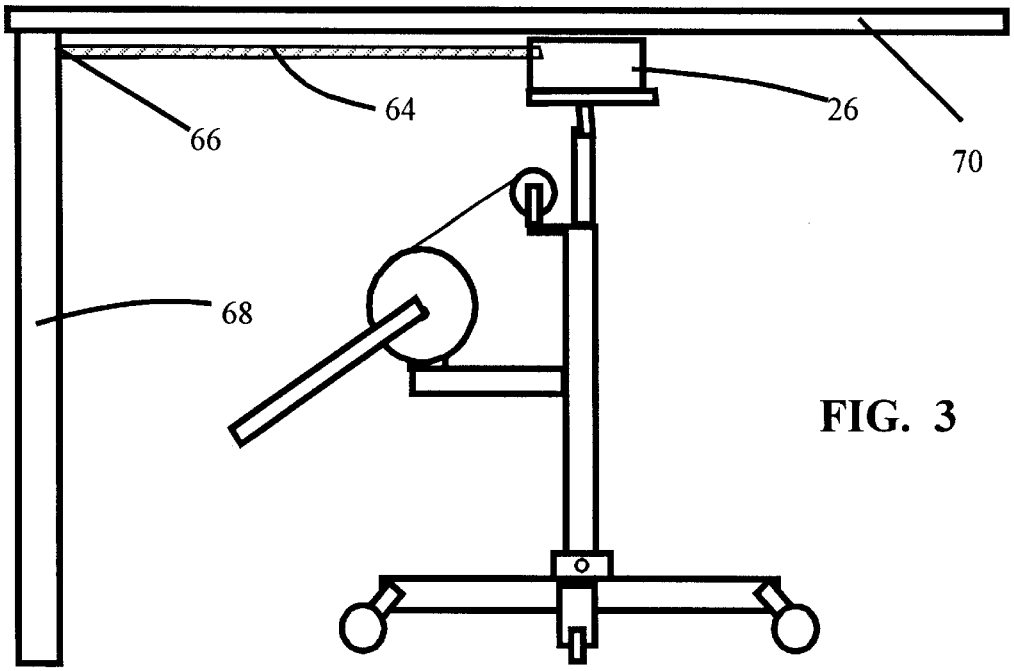
FIG. 3 shows a side view of the hoisting apparatus of the present invention in a post installation position.

Referring now to FIGS. 1–3, the hoisting apparatus of the present invention, generally indicated by the numeral 10. The device is designed specifically to facilitate installment of garage door openers. Prior art methods require the use of a ladder, whereby the installer would position the ladder proximate the installation point, and climb up the ladder holding the motor and motor housing. Typically two persons are required as one person cannot support, balance, and position the motor and motor housing while securing the same to the ceiling. The suffers from the drawback in that one or more persons is bearing the weight of a relatively heavy load while standing on the ladder, an obvious safety hazard. Also, for a company which installs many such garage door openers, excessive manpower is required thereby reducing profit and increasing installation.

The apparatus 10, has three main components. A base platform 12, having a plurality of wheels 14 extending therefrom and a centrally located receptacle 16, an extensible shaft assembly 18 which can be raised and lowered as required by a crank assembly 20, and a pivoting workpiece holder 22 for supporting the garage door opener motor 24, which may be contained within a housing 26.

The base platform 12, which may be rectangular has wheels 14 so that the apparatus 10 may be easily positioned to facilitate placement of the garage door opener motor 24 during installation. The base 12 is made of a strong durable material such as metal and has a receptacle 16 therein sized for receiving a telescoping shaft assembly as will be explained in more detail later. The base platform 12 is sufficiently wide to allow for stability when loaded with a workpiece, i.e., the garage door opener. A width of about 3 feet is preferable. A much wider base 12 would add more stability but would reduce the ease with which the apparatus 10 could be stored and transported. The receptacle 16 has an aperture 32 through which a bolt 34 may be inserted in order to secure the shaft assembly 18.

The shaft assembly 18 has at least two nested sections 38, 40 which are secured within receptacle 16 by bolt 32 which extends through apertures (not shown) in section 38. A bolt 44 or other type of mechanism may be used to secure section 40 at the desired extension. It can be readily appreciated that the bolt 44 would have to extend through an appropriately sized aperture in section 40.

Secured to section 38 of the shaft assembly 18 is the crank assembly 20. A first horizontally extending support member 48 is used to support master pulley wheel 50, and a second horizontally extending support member 52 is used to support slave pulley wheel 54. Both support members 48, 50 may be provided with releasable attachment means (not shown) to facilitate disassembly when the apparatus must be stored in a restricted space such as the rear of a van. A cable 58 is wound onto master pulley wheel 50 and looped onto slave pulley wheel 54. The cable 58 extends into the interior of section 38 where it is securely attached to section 40. The handle 59 of the crank assembly 20 may be rotated in either direction to effect raising and lowering of the section 40. Locking means may be provided to lock master pulley wheel 50 in position.

Self leveling workpiece holder 22 is pivotally attached to the top end of telescoping section 40 via arms 62. Any of several well known mechanisms may be employed to pivotally attach the arms 62 to section 40 which will allow for selectively locking the workpiece holder in position. It can be appreciated by viewing FIGS. 2 and 3 that the workpiece holder 22 is self leveling since the position of the drive shaft 64 of the motor 24 requires the motor to be at a first angle as shown in FIG. 2, while it is essentially level once the telescoping section 40 is raised to allow for installation of the motor 24 and motor housing. Means may be provided for locking the workpiece holder 22 in position at a desired angle.

In operation, the motor 24 and motor housing 26, which may be placed upon the workpiece holder 22, are positioned so that the drive shaft 64 extends to the connection point 66 on the garage door 68. Crank handle 59 is then rotated thereby causing the section 40 to extend. Wheels 14 facilitate positioning of the apparatus 10 the exact location required for installation. When the section 40 has extended to a desired position, the workpiece holder 22, which is normally freely pivoting, will be level and the installer may then attach the housing 26 and motor 24 to the garage ceiling 70. When the motor 24 and housing 26 are secured, the section 40 may then be fully retracted for storage. As has been previously mentioned, both sections 38 and 40 may be detached for storage. If desired, releasable connection means may be used to secure the crank assembly 20 to allow for breaking down the apparatus 10 for more compact storage.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. A method of installing a garage door opening mechanism having a drive shaft extending therefrom comprising the steps of:

securing said garage door opening mechanism within a workpiece holder, said workpiece holder being pivotally attached to a telescoping member extending from a workpiece positioning device having a main body;

positioning the main body of said workpiece positioning device while simultaneously adjusting the workpiece holder so as to place an attachment end of said drive shaft proximate a desired attachment point;

attaching said attachment end of said drive shaft to the desired attachment point;

leveling said garage door opening mechanism by extending said telescoping member to position said garage door opening mechanism at a height whereby said drive shaft is substantially level, and securing said garage door opening mechanism to an adjacent securing assembly.

* * * * *